US010465425B2

(12) United States Patent
Clark et al.

(10) Patent No.: US 10,465,425 B2
(45) Date of Patent: Nov. 5, 2019

(54) SINGLE STAGE LEADSCREW CINCH ACTUATOR

(71) Applicant: Magna Closures Inc., Newmarket (CA)

(72) Inventors: John Edward Clark, Maple (CA); Ilya Neyman, Thornhill (CA); Dani Andraos, Richmond Hill (CA); John Robert Scott Mitchell, Newmarket (CA); John Distefano, Richmond Hill (CA); Shant Pailian, Toronto (CA)

(73) Assignee: MAGNA CLOSURES INC., Newmarket (CA)

( * ) Notice: Subject to any disclaimer, the term of this patent is extended or adjusted under 35 U.S.C. 154(b) by 973 days.

(21) Appl. No.: 14/841,860

(22) Filed: Sep. 1, 2015

(65) Prior Publication Data

US 2016/0060922 A1 Mar. 3, 2016

Related U.S. Application Data

(60) Provisional application No. 62/138,634, filed on Mar. 26, 2015, provisional application No. 62/045,403, filed on Sep. 3, 2014.

(51) Int. Cl.
*E05B 81/24* (2014.01)
*E05B 81/06* (2014.01)
(Continued)

(52) U.S. Cl.
CPC ..... *E05B 81/06* (2013.01); *E05B 81/25* (2013.01); *E05B 81/34* (2013.01); *E05B 81/64* (2013.01);
(Continued)

(58) Field of Classification Search
CPC ..... Y10T 292/1021; Y10T 292/1082; Y10T 292/14
(Continued)

(56) References Cited

U.S. PATENT DOCUMENTS 3,767,240 A * 10/1973 Belanger ..... E05B 47/0012 292/144
4,135,377 A * 1/1979 Kleefeldt ..... E05B 81/25 292/144
(Continued)

FOREIGN PATENT DOCUMENTS

CN 103114777 A 5/2013
CN 103732845 A 4/2014

OTHER PUBLICATIONS

Search Report dated Aug. 24, 2018 from corresponding Chinese Patent Application No. 201510552570.6.

*Primary Examiner* — Carlos Lugo
(74) *Attorney, Agent, or Firm* — Dickinson Wright PLLC

(57) ABSTRACT

A door latch assembly for an automotive vehicle door includes a gearless cinch actuator. The cinch actuator includes an extensible housing member connected to a threaded rod by a nut. The extensible housing member is also connected to a cable for cinching the door. A motor rotates the threaded rod, which moves the extensible housing member between rest and cinched positions. The motor is connected to the threaded rod without the use of gears. An anti-friction agent, such as a combination of a PTFE-containing coating and PTFE-containing grease, is applied between the nut and the threaded rod. The materials and anti-friction agent used at the interface of the threaded rod and nut together provide a friction coefficient (μ) of about 0.045 or less.

21 Claims, 6 Drawing Sheets

(51) Int. Cl.
*E05B 81/34* (2014.01)
*E05B 81/64* (2014.01)

(52) U.S. Cl.
CPC .... *Y10T 292/1021* (2015.04); *Y10T 292/1082* (2015.04); *Y10T 292/14* (2015.04)

(58) Field of Classification Search
USPC ..... 292/144, 201, 252
See application file for complete search history.

(56) References Cited

U.S. PATENT DOCUMENTS 4,257,634 A * 3/1981 Kleefeldt ..... E05B 81/25 292/201
4,354,396 A * 10/1982 Charles ..... F16H 25/20 74/104
4,374,597 A * 2/1983 Mochida ..... F16C 1/10 292/336.3
4,458,930 A * 7/1984 Goike ..... B60K 15/05 292/201
4,669,283 A * 6/1987 Ingenhoven ..... E05B 81/25 292/144
4,674,781 A * 6/1987 Reece ..... E05B 81/25 292/201
4,691,584 A 9/1987 Takaishi et al.
4,708,378 A * 11/1987 Ingenhoven ..... E05B 81/25 292/201
4,723,454 A * 2/1988 Periou ..... E05B 81/25 292/201
4,799,719 A * 1/1989 Wood ..... E05B 47/0012 292/144
4,850,466 A * 7/1989 Rogakos ..... E05B 81/25 192/105 BA
4,941,694 A * 7/1990 Bartel ..... E05B 81/25 292/201
4,978,155 A * 12/1990 Kobayashi ..... E05B 81/25 292/201
5,037,145 A * 8/1991 Wilkes ..... E05B 81/25 292/201
5,079,964 A * 1/1992 Hamada ..... E05B 81/25 292/201
5,137,312 A * 8/1992 Tang ..... E05B 81/25 292/201
5,149,156 A * 9/1992 Kleefeldt ..... E05B 81/25 292/201
5,186,516 A * 2/1993 Alexander ..... B60J 7/1851 292/251
5,214,332 A * 5/1993 Tsutsumi ..... E05B 81/25 292/336.3
5,263,751 A * 11/1993 Priest ..... E05B 47/0603 292/201
5,358,274 A * 10/1994 Watanabe ..... B60R 22/201 280/801.2
5,443,292 A * 8/1995 Shimada ..... E05B 81/20 292/201
5,472,065 A * 12/1995 Vergin ..... E05B 81/25 185/40 R
5,473,922 A * 12/1995 Bair ..... E05B 47/0012 292/144
5,546,777 A * 8/1996 Liu ..... E05B 81/25 292/144
5,634,676 A * 6/1997 Feder ..... E05B 81/25 292/144
5,647,234 A * 7/1997 Foster ..... E05B 85/14 292/DIG. 25
5,746,459 A * 5/1998 Giroux, Jr. ..... E05B 81/22 292/341.13
5,865,272 A * 2/1999 Wiggins ..... F16H 25/2018 185/40 R
5,890,393 A * 4/1999 Ohta ..... E05B 81/25 464/57
5,983,739 A * 11/1999 Feder ..... E05B 81/25 70/280
6,053,542 A * 4/2000 Ostrowski ..... E05B 81/20 292/201
6,109,124 A * 8/2000 Chen ..... E05B 81/25 192/54.5
6,119,538 A * 9/2000 Chang ..... E05B 81/25 292/144
6,280,592 B1 * 8/2001 Mastrofrancesco .... E05B 15/16 204/485
6,308,587 B1 * 10/2001 Shinkawa ..... E05B 81/25 185/40 B
6,318,196 B1 * 11/2001 Chang ..... E05B 81/25 292/144
6,341,448 B1 1/2002 Murray et al.
6,391,258 B1 * 5/2002 Peake ..... A61L 2/24 292/145
6,619,085 B1 * 9/2003 Hsieh ..... E05B 47/0012 292/144
6,669,249 B1 * 12/2003 Huang ..... E05B 9/02 292/337
6,813,916 B2 * 11/2004 Chang ..... E05B 47/0012 292/144
6,848,727 B1 2/2005 Cetnar et al.
7,175,212 B2 2/2007 Cetnar et al.
7,770,944 B2 * 8/2010 Yuan ..... E05B 47/0012 292/195
8,528,948 B2 9/2013 Bettin et al.
9,541,186 B2 * 1/2017 Kanzaki ..... F16H 57/02
2004/0075285 A1 * 4/2004 Murayama ..... E05C 17/203 292/265
2004/0159518 A1 8/2004 Oberheide
2010/0109346 A1 * 5/2010 Dieling ..... B64C 1/1407 292/90
2013/0152644 A1 6/2013 Bendel et al.
2014/0117682 A1 * 5/2014 Konchan ..... E05B 79/20 292/336.3

* cited by examiner

SINGLE STAGE LEADSCREW CINCH ACTUATOR

CROSS REFERENCE TO RELATED APPLICATION

This U.S. patent application claims the benefit of U.S. provisional patent application No. 62/045,403, filed Sep. 3, 2014, and U.S. provisional patent application No. 62/138,634, filed Mar. 26, 2015, the entire content of which are incorporated herein by reference.

BACKGROUND

1. Field of the Invention

The present invention relates to a cinch actuator, and more particularly to a single stage, leadscrew, gearless linear cinch actuator for automotive vehicle door latch applications.

2. Related Art

Actuators are oftentimes used in automotive vehicles to cinch a latch of a vehicle door. Such actuators typically include an actuation device, such as a motor, and a drive assembly coupled to the door latch via a cable. Examples of such actuators are disclosed in U.S. Patent Application Publication Nos. 2013/0152644 and 2004/0159518, and U.S. Pat. No. 6,341,448.

The known cinch actuators typically include a plurality of gears, which can lead to undesirable noise. In addition, it is desirable to reduce the number of components and costs associated with such cinch actuators, especially those designed for vehicle door latch applications.

SUMMARY

A low cost, gearless linear cinch actuator providing reduced noise and small packaging size is provided. The actuator includes a threaded rod, and extensible housing member, a nut, and a motor. The threaded rod extends along a load axis between a first end and a second end, the extensible housing member surrounds the load axis, and a nut connects the threaded rod to the extensible housing member. A motor is connected to the first end of the threaded rod for rotating the threaded rod in a first direction which moves the extensible housing member along the load axis toward the motor from a rest position to a fully cinched position, and for rotating the threaded rod in a second direction which moves the extensible housing member along the load axis away from the motor and from the fully cinched position to the rest position. The motor is connected to the threaded rod without the use of gears, and an anti-friction agent is disposed between the nut and the threaded rod.

Another aspect includes a door latch assembly for an automotive vehicle, comprising a door latch, a cable for cinching the door latch, and the cinch actuator for pulling the cable to cinch the door latch. The cinch actuator can be used to cinch a side door of the vehicle. However, the cinch actuator can also be used in many other applications.

A method of manufacturing the cinch actuator is also provided. The method includes providing a threaded rod extending along a load axis between a first end and a second end; disposing an extensible housing member around the load axis; and connecting the threaded rod to the extensible housing member with a nut. The method further includes connecting a motor to the first end of the threaded rod for rotating the threaded rod in a first direction which moves the extensible housing member along the load axis toward the motor from a rest position to a fully cinched position, and for rotating the threaded rod in a second direction which moves the extensible housing member along the load axis away from the motor and from the fully cinched position to the rest position. The step of connecting the motor to the threaded rod is done without the use of gears. The method further includes applying an anti-friction agent between the nut and the threaded rod.

BRIEF DESCRIPTION OF THE DRAWINGS

Other advantages of the present embodiments will be readily appreciated, as the same becomes better understood by reference to the following detailed description when considered in connection with the accompanying drawings wherein.

DETAILED DESCRIPTION OF EXAMPLE EMBODIMENTS

Figure 1:
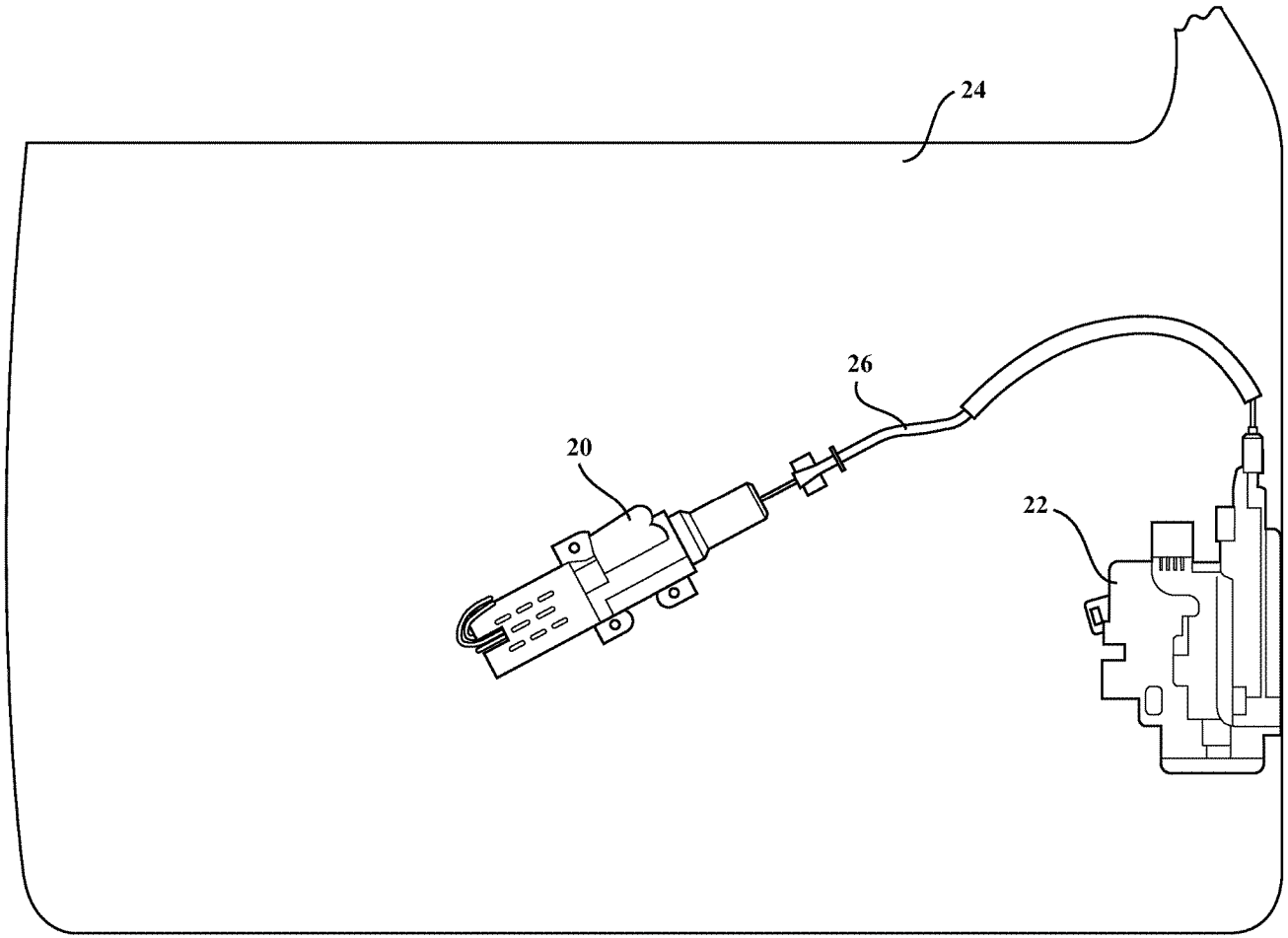
FIG. 1 illustrates an example actuator coupled to a door latch by a cable in a vehicle door application.

Referring to the Figures, a single stage leadscrew cinch actuator 20, also referred to as a gearless linear actuator, providing for reduced noise, small packaging size, and reduced costs is generally shown. The actuator 20 is typically used in a vehicle application, for example to cinch a door latch 22 of a vehicle door 24 via a cable 26, as shown in FIG. 1. However, the actuator 20 could also be used to pressurize other closure equipment or activate other components. In addition, the actuator 20 could be used in other automotive applications or non-automotive applications. The Figures accompanying the subject disclosure show an example of the linear actuator 20, specifically a single stage, leadscrew drive actuator with a floating connection to a cinch cable for door latch cinch activation, but the actuator 20 could comprise other designs.

Figure 2:
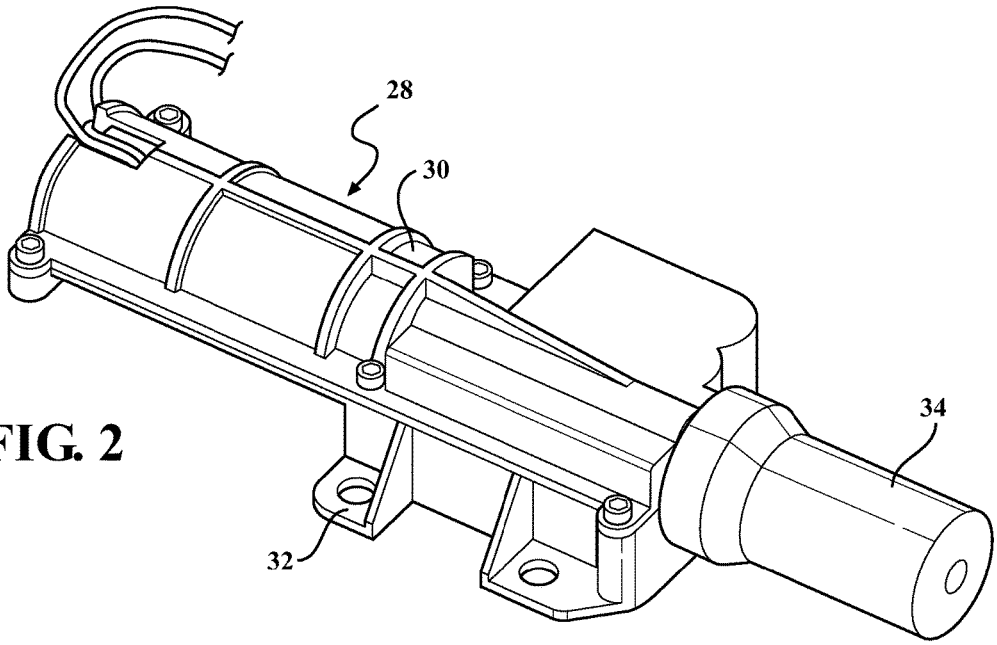
FIG. 2 is a perspective view of the example actuator showing a housing assembly.

As shown in FIG. 2, the example actuator 20 includes a housing assembly 28 having a plurality of housing units 30, 32, 34. The housing assembly 28 can be coupled to the vehicle door 24 by any suitable method. The housing assembly 28 also protects the functional components of the actuator 20, including a linear actuation device 36 and drive assembly 38. In the example embodiment, the housing assembly 28 includes a top housing 30, bottom housing 32, and a cable cover 34. The top housing 30 and bottom housing 32 are screwed together, and the cable cover 34 is attached to an end surface of both the top and bottom housing 30, 32.

Figure 3:
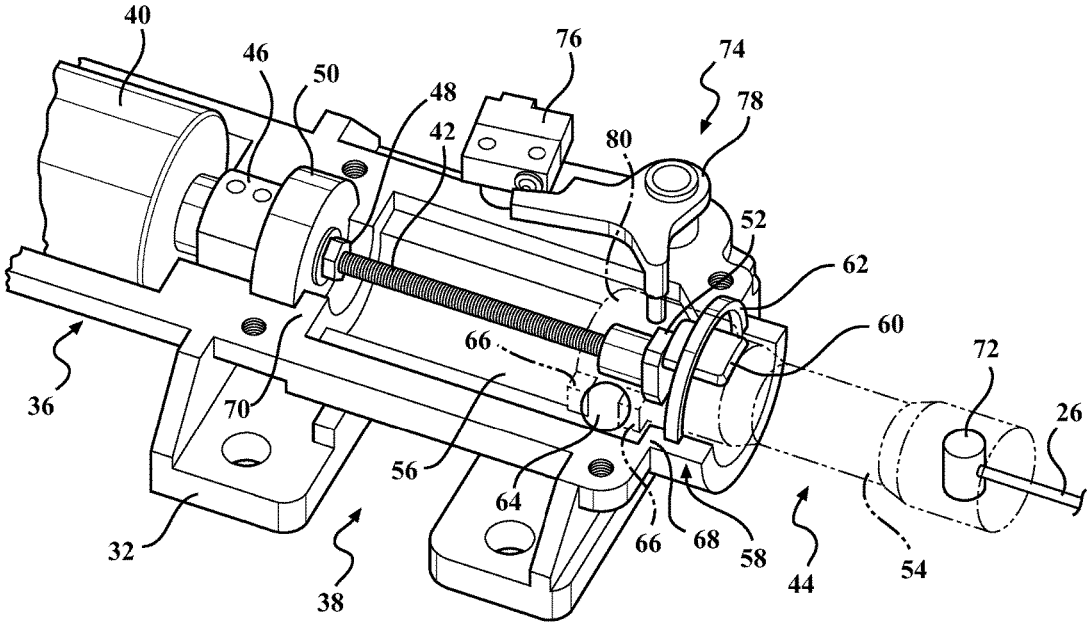
FIG. 3 illustrates the example actuator with a portion of the housing assembly removed to show a linear actuation device and drive assembly.
Figure 4:
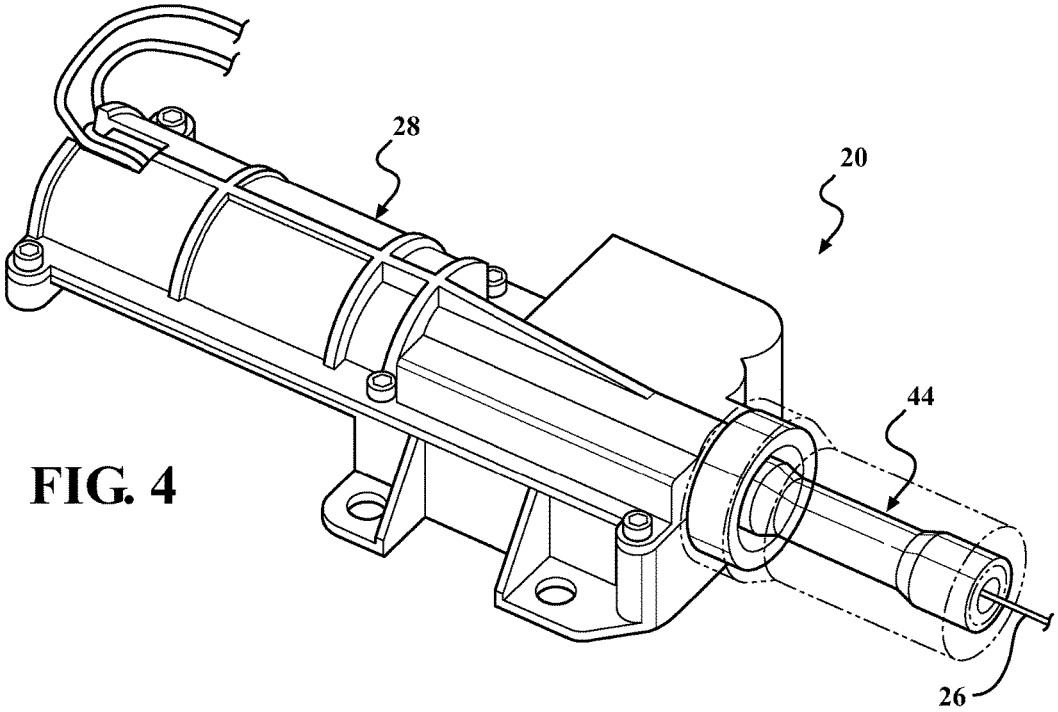
FIG. 4 shows the example actuator in a fully open position.

FIG. 3 illustrates the example actuator 20 with the top housing 30 and cable cover 34 removed to show the linear actuation device 36 and the drive assembly 38. The linear actuation device 36 moves the drive assembly 38 linearly between a fully open position, as shown in FIGS. 3 and 4, and a fully cinched position, as show in FIG. 5. The fully open position is also referred to as a rest position. When the actuator 20 is used in a door vehicle and the drive assembly 38 is in the fully open position, the door latch 22 is not cinched, and thus the door can be opened or closed upon actuation of a door handle. When the drive assembly 38 is in the cinched position, the door latch 22 is cinched, and thus the door cannot be opened or closed upon actuation of a door handle.

As shown in FIG. 3, the linear actuation device 36 of the example embodiment includes a motor 40, and the drive assembly 38 includes a threaded rod 42 coupled to an extensible unit 44. A rotary output of the motor 40 is coupled to the threaded rod 42 by an adapter 46 and fastened thereto by a counternut 48. A bearing 50 is also disposed between the adapter 46 and counternut 48 to rotatably support a first end of the threaded rod 42. In the example embodiment, only the bearing 50 controls the axial alignment of the components disposed within the housing assembly 28, so that the actuator 20 is not constrained at both ends. The motor 40 rotates in both clockwise and counterclockwise directions, and in turn rotates the threaded rod 42 in the same direction. The motor 40 rotates the threaded rod 42 in a first direction to move the extensible unit 44 from the fully opened position to the fully cinched position. When the threaded rod 42 rotates in the first direction, the extensible unit 44 moves along the load axis into the housing assembly 28 and toward the motor 40. The motor 40 also rotates the threaded rod 42 in a second opposite direction to move the extensible unit 44 from the fully cinched to the fully opened position. When the threaded rod 42 rotates in the second direction, the extensible unit 44 moves along the load axis, out of the housing assembly 28, and away from the motor 40. In the example embodiment wherein the actuator 20 is used in a door vehicle, the motor 40 moves the threaded rod 42 and thus extensible unit 44 in the first direction to the fully cinched position when the vehicle door is shut. After reaching the fully cinched position, in which case the vehicle door latch 22 is cinched, the motor 40 moves the threaded rod 42 and the extensible unit 44 in the second direction back to the fully open position, which is the rest position. In the rest position, the door will remain latched, but can be opened upon actuation of the door handle.

Figure 5:
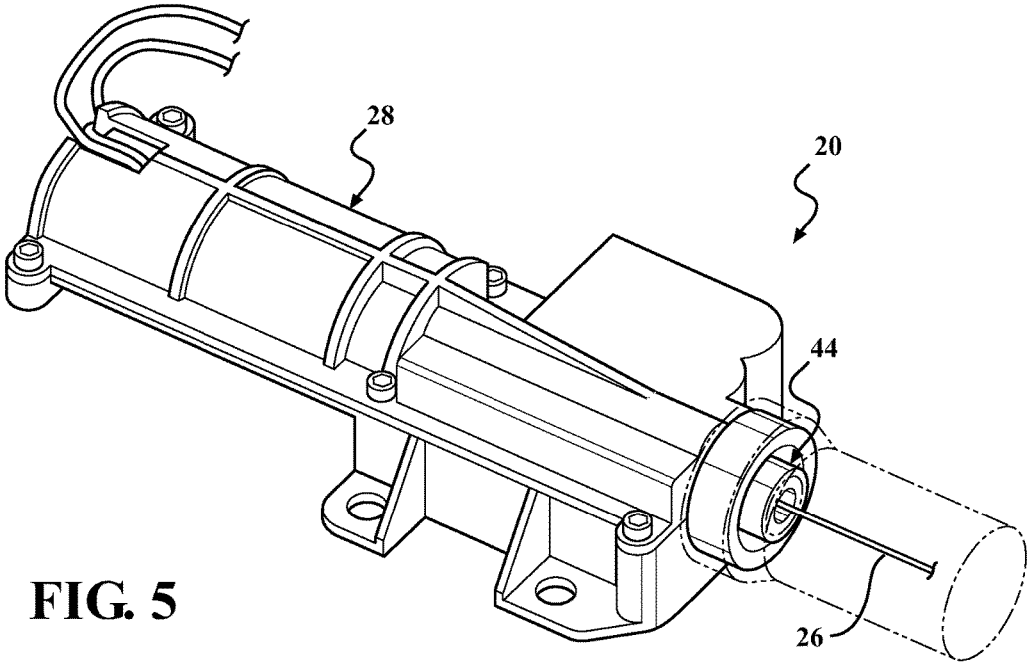
FIG. 5 shows the example actuator in a fully cinched position.
Figure 6:
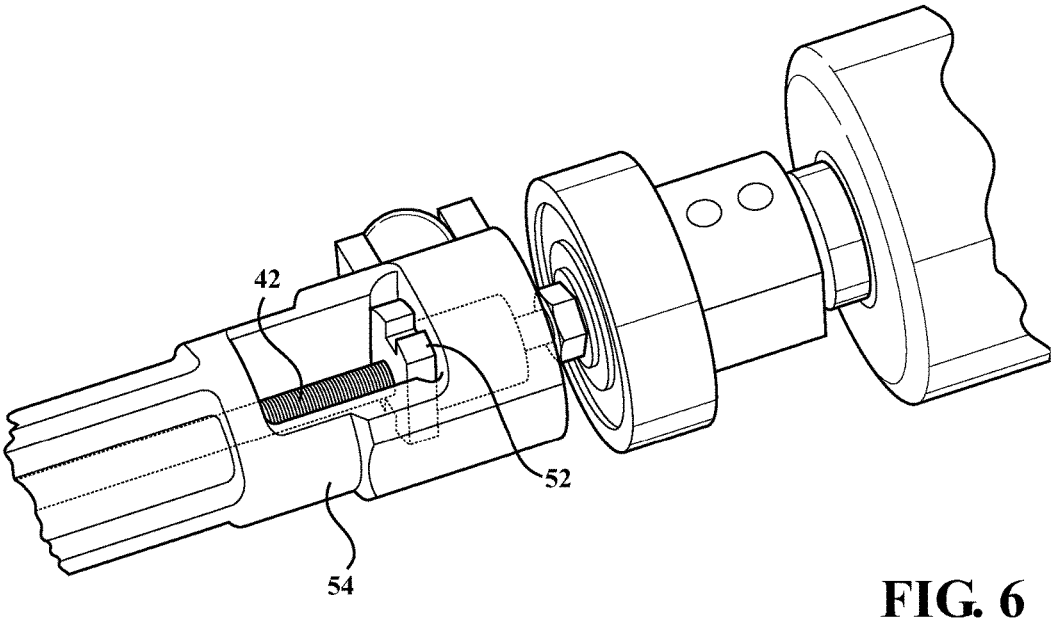
FIG. 6 is an enlarged view of a threaded rod, nut housing, and nut of the example actuator.
Figure 7:
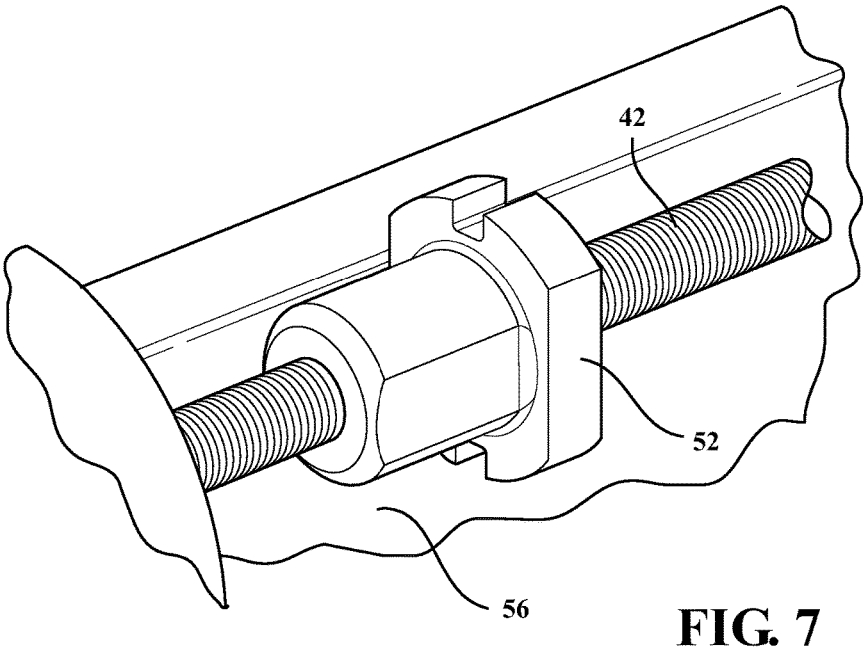
FIG. 7 is an enlarged view of the interface between the threaded rod and nut housing of the example actuator.

As best shown in FIGS. 3, 6, and 7 the extensible unit 44 of the example embodiment includes a nut 52 and an extensible housing member, also referred to as a nut housing 54, contained within a chamber 56 defined by the housing assembly 28. The nut 52 includes internal threads which are threadedly coupled to external threads of the threaded rod 42. In the example embodiment, the nut 52 is coupled to and contained within the nut housing 54. However, the nut 52 and nut housing 54 could alternatively comprise a single unit. When the extensible unit 44 is in the fully open position, shown in FIGS. 3 and 4, a portion of the nut housing 54 extends outwardly of the chamber 56. When the extensible unit 44 is in the fully cinched position, shown in FIG. 5, the entire nut housing 54, or majority of the nut housing 54, is retracted into the chamber 56 of the housing assembly 28.

The interface between the threaded rod 42 and nut 52 is preferably designed to minimize operating sound and avoid the use of gears. In the example embodiment, the design uses an in-line direct drive system including the nut 52 and the leading threaded rod 42. However, belt or pulley drive systems are also possible. The threaded rod 42 includes one or more threads which present a thread pitch and thread diameter. The smallest possible thread pitch should be used to maximize force output, according to the following equation:

$$\text{Torque}*\#\text{Radians}=\text{Efficiency}*\text{Force}*\text{Distance}$$

When a small thread pitch is used, the thread strength, activation time, and motor selection should also be carefully considered, and the requirements for each depend on the particular application of the actuator 20. Reducing thread pitch results in a lower required input torque, which in turn could result in a smaller motor at a lower cost. The smallest possible thread diameter should also be used to optimize efficiency and minimize sensitivity to friction. For example, a small thread diameter compared to a large thread diameter, with the same thread pitch, results in a higher lead angle, and a higher lead angle results in increased efficiency and less sensitivity to friction. Another advantage of a high lead angle is that it allows for manual backdrive.

The interface between the threaded rod 42 and nut 52 should also be designed with the smallest friction coefficient possible to minimize friction and increase efficiency. The materials used to form the nut 52 and threaded rod 42 are selected to achieve the low friction coefficient. The threaded rod 42 and nut 52 are typically formed of standard materials capable of achieving the low friction coefficient. For example, the threaded rod 42 can be formed of steel, such as a standard steel thread obtained from M3 Steel Structures, Ltd. Likewise, the nut 52 can be formed of standard automotive plastic material. In one embodiment, the nut 52 and nut housing 54 are formed of the same plastic material, which allows integration of the two components and thus provides a further cost advantage. The use of components having standard designs provides for reduced tooling costs and reduced measuring equipment costs, compared to custom designs.

To further reduce the friction coefficient, anti-friction coatings, greases, or combinations thereof are applied to the interface of the threaded rod 42 and nut 52. In addition to improving performance of the actuator 20, the anti-friction coatings and greases prevent wear along the interface and thus prolong the life of the nut 52 and threaded rod 42.

FIG. 7 is an enlarged view of the interface between the threaded rod 42 and nut 52 of the example actuator 20. In this embodiment, the threaded rod 42 is formed of steel. The threaded rod 42 also has a fine thread pitch of about 0.5 mm ore less, and a thread diameter of about 3.0 mm ore less with a lead angle of about 3.4 degrees or higher. The nut 52 is formed of an acetal homopolymer resin, such as Delrin® 100. An anti-friction agent, such as an anti-friction coating and/or an anti-friction grease is also applied to the interface of the threaded rod 42 and nut 52. In the example embodiment, at least one of the anti-friction coating and the anti-friction grease includes polytetrafluoroethylene (PTFE). A combination of the anti-friction coating and grease could also be applied to the interface of the threaded rod 42 and nut 52. For example, the combination could include a polytetrafluoroethylene (PTFE) anti-friction coating, such as BERUCOAT AF 320, and anti-friction grease including PTFE powder, such as BERULAB FR 43, applied over the anti-friction coating. The materials and anti-friction agents used at the interface of the threaded rod 42 and nut 52 together provide a very low friction coefficient ($\mu$) of about 0.045 or less.

The actuator 20 further includes an anti-rotation or linear guide device 58 which prevents rotation of the extensible member 44, including the nut 52 and nut housing 54, and thus drives the extensible member 44, including the nut 52 and nut housing 54, in a linear direction. The linear guide device 58 can move the nut housing 54 to the extended position, referred to as the fully open position, or the retracted position, referred to as the, fully cinched position. In the example embodiment, the linear guide device 58 is provided to prevent rotation of the extensible unit 44 during rotation of the threaded rod 42. In this embodiment, the linear guide device 58 includes a retaining clip 60 and a damper 62 disposed between the nut housing 54 and the housing assembly 28 to limit rotational movement of the nut housing 54.

Figure 8:
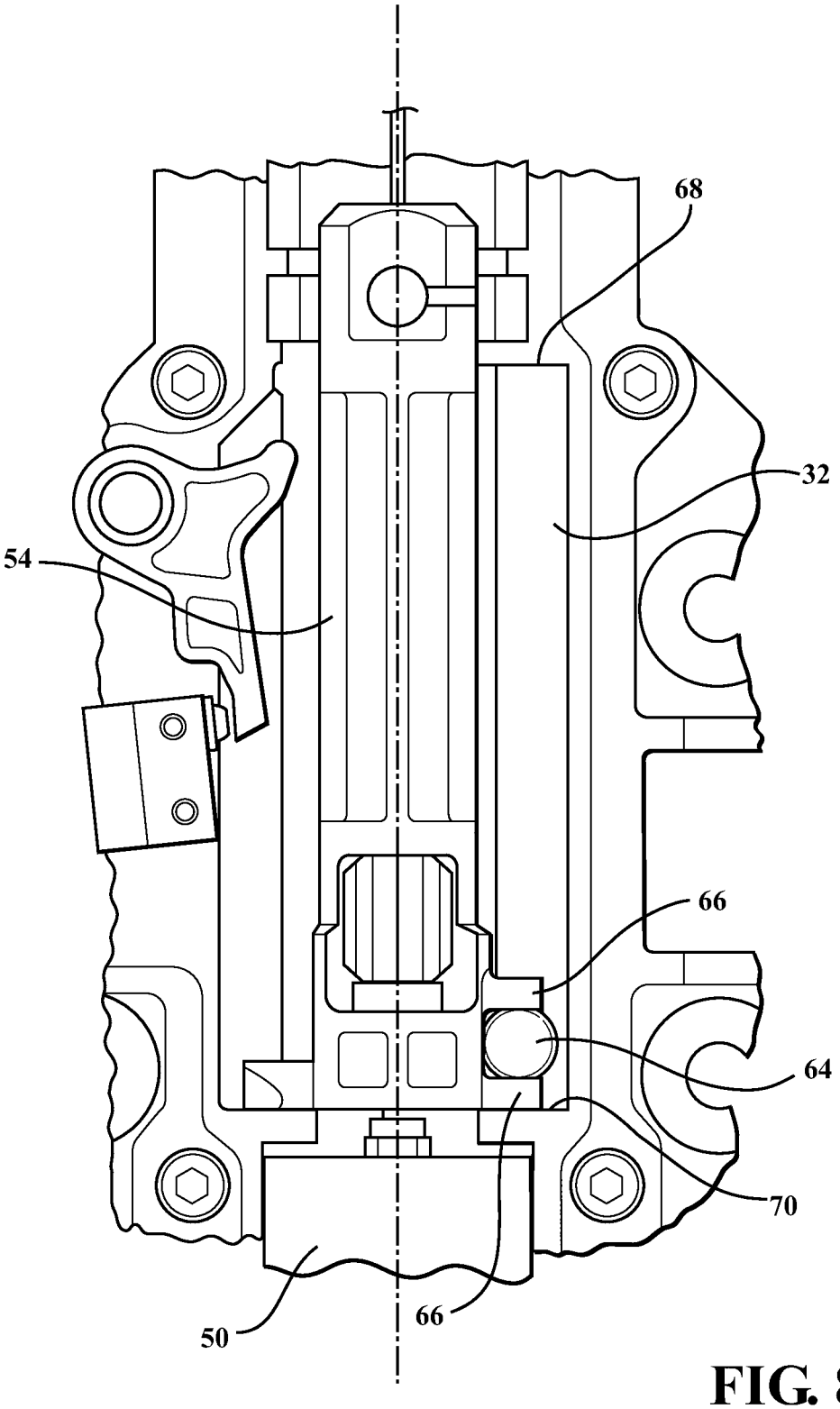
FIG. 8 is an enlarged top view of the nut housing of the example actuator.

The linear guide device 58 also includes a ball 64 contained between two radially outwardly extending ribs 66 on the nut housing 54, which allows the nut housing 54 to float within the chamber 56 of the housing assembly 28. FIG. 8 is an enlarged top view of the floating nut housing 54 of the example actuator 20. As the ball 64 rolls along the bottom housing 32, the nut housing 54 moves linearly, either retracting into the chamber 56 or extending outwardly of the chamber 56, until one of the ribs 66 surrounding the ball 64 engages a front interior wall 68 or back interior wall 70 of the chamber 56. The force between the ball 64 and the bottom housing 32 further inhibits rotational movement of the nut housing 54 and guides the nut housing 54 in the linear direction. Another advantage of the floating nut housing 54 is that it minimizes sensitivity to tolerances. For example, the effect of load application misalignment or running out of the threaded rod 42 is minimized. The component costs and sensitivity to supplier manufacturing capability is also reduced. Furthermore, like the unconstrained threaded rod 42 and nut 52, the nut housing 54 is also not constrained at the cable end, but rather guided by the ball 64, and thus is flexible enough to accommodate slight axial misalignment. This provides advantages over other designs which use a guide, two bearings, or a linear bearing, and thus require high precision manufacturing.

Figure 9:
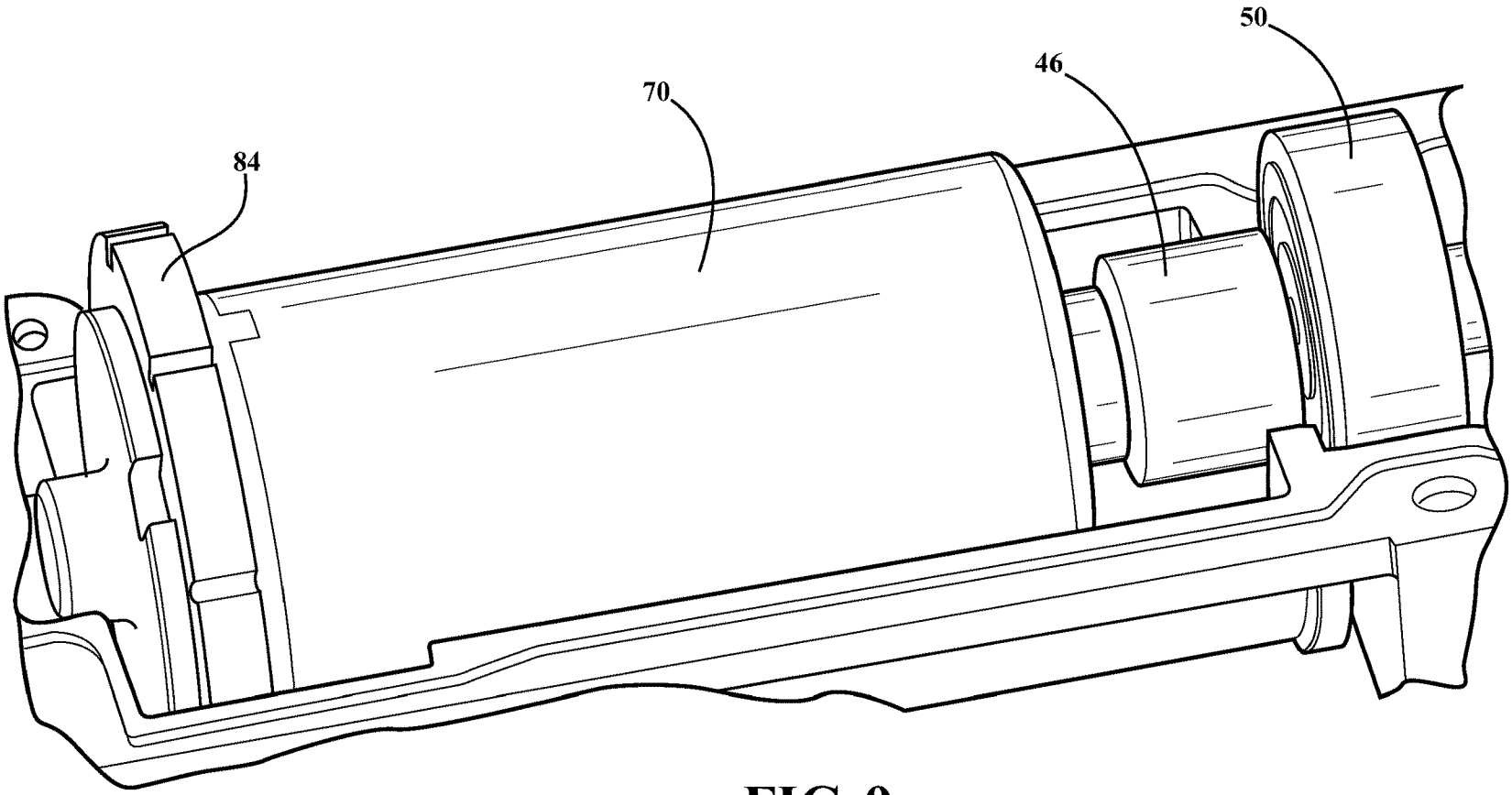
FIG. 9 is an enlarged view of a motor of the example actuator.

As shown in FIG. 9, the motor 40 is also preferably designed with a floating connection, axially de-coupled from the threaded rod 42 and nut 52 assembly, to minimize sensitivity to tolerances. In the example embodiment, the motor 40 is connected to the threaded rod 42 and nut 52 assembly through the adaptor 46 on one end. A motor support 84 is disposed between the motor 40 and the housing assembly 28 on the other end. This floating connection minimizes effects of axial misalignment due to component tolerances. As shown in FIG. 9, a shaft of the motor 40 is lightly press fit onto the adaptor 46, but is not constrained in the axial direction. The motor support 84 is typically a ring formed of rubber, which can absorb slight misalignment of the motor 40 without affecting the alignment of the threaded rod 42 and nut 52.

As shown in FIGS. 3-5, the nut housing 54 of the actuator 20 is coupled to the cable 26, such as a Bowden cable, which is then coupled to the door latch 22. However, another type of cable or connecting device could be used to couple the actuator 20 to the door latch 22. Alternatively, the cable 26 can couple the extensible unit 44 to another component to be actuated. In the example embodiment, the proximal end of the cable 26 includes a ferrule 72 disposed in a slot adjacent a distal end of the nut housing 54. However, the cable 26 could be coupled to the nut housing 54 by other methods. Typically, when the nut housing 54 retracts from the fully open position to the fully cinched position, the nut housing 54 pulls the cable 26 and thus activates the door latch cinch. When the nut housing 54 moves from the fully clinched position back to the fully open position, it allows the cable 26 and door latch 22 to return to a rest position.

As shown in FIG. 1, the cable 26 typically couples the nut housing 54 to a movable component of the door latch 22, such as a lever or a cam mechanism. In the example embodiment, the cable 26 is pulled only. In this embodiment, the actuator 20 is a cinch actuator and not designed to perform a release operation when moving in the opposite direction. The extensible housing member 54 of the actuator 20 will move or backdrive to the fully open position after it performs a cinch operation, with very small load from the latch 22 as the activated, spring loaded latch lever or cam returns back to its rest position. When the actuator 20 is in the fully opened position, referred to as the rest position, the vehicle door can be opened by actuation of the door handle.

Various different types of latches 22 can be used with the actuator 20. The actuator 10 of the example embodiment is developed as a stand alone assembly thus there is no specific latch required. U.S. Pat. Nos. 7,175,212 and 6,848,727 disclose examples of cinch latches that can be used with the actuator 20.

The actuator 20 of the example embodiment further includes a position detector 74 for detecting when the extensible member 44 is in the fully open position or fully cinched position. In the example embodiment shown in FIG. 3, the position detector 74 includes a switch 76 and a switch lever 78. A spring (not shown) biases the switch lever 78 toward the switch 76, i.e. towards a switch closed position. When the extensible member 44 is in the fully open position, a radially outwardly extending tab 80 on the nut housing 54 prevents the switch lever 78 from engaging the switch 76. However, when the extensible member 44 retracts toward the fully cinched position, the tab 80 disengages from the switch lever 78 and allows the switch lever 78 to engage a button on the switch 76. The switch 76 can be in communication with a control unit (not shown) of the vehicle.

Many modifications and variations to the above embodiments, and alternate embodiments and aspects are possible in light of the above teachings and may be practiced otherwise than as specifically described while falling within the scope of the following claims.

What is claimed is:

1. A cinch actuator for a latch of a door to cinch the latch via movement by an actuator of the cinch actuator from a rest position, whereat the latch can be released to allow the door to be opened from a latched, closed position, to a fully cinched position, whereat the latch cannot be released to prevent the door from being opened from the latched, closed position, comprising:

a housing assembly;

a threaded rod extending along a load axis between a first end and a second end;

an extensible housing member surrounding said load axis;

a nut connecting said threaded rod to said extensible housing member, said nut being fixed against relative movement with said extensible housing member;

a motor connected to said first end of said threaded rod for rotating said threaded rod in a first direction which moves said extensible housing member along said load axis toward said motor from a rest position to a fully cinched position, and for rotating said threaded rod in a second direction which moves said extensible housing member along said load axis away from said motor and from the fully cinched position to the rest position; and wherein said housing assembly and said extensible housing member defines a linear guide device for inhibiting rotational movement of said extensible housing member during rotation of said threaded rod as said extensible housing member moves along said load axis between the rest position and the fully cinched position.

2. The cinch actuator of claim 1, further including an anti-friction agent including at least one of an anti-friction coating and anti-friction grease disposed between said nut and said threaded rod.

3. The cinch actuator of claim 2, wherein at least one of said anti-friction coating and said anti-friction grease includes polytetrafluoroethylene (PTFE).

4. The cinch actuator of claim 3, wherein said anti-friction agent includes a combination of said anti-friction coating and said anti-friction grease, and said anti-friction coating and said anti-friction grease each include polytetrafluoroethylene (PTFE).

5. The cinch actuator of claim 2, wherein said nut includes at least one thread engaging said threaded rod, and wherein said anti-friction agent is applied to said at least one thread of said nut and said threaded rod.

6. The cinch actuator of claim 1, wherein said threaded rod is formed of steel and said nut is formed of an acetal homopolymer resin.

7. The cinch actuator of claim 1, wherein the co-efficient of friction at an interface between said threaded rod and said nut is about 0.045 or less.

8. The cinch actuator of claim 1, wherein said motor is coupled to said threaded rod by an adapter and a counternut.

9. The cinch actuator of claim 1, wherein said threaded rod has a thread pitch of about 0.5 mm or less; a thread diameter of about 3.0 mm or less, and a lead angle of about 3.4 degrees or higher.

10. The cinch actuator of claim 1, wherein said extensible housing member and said nut are formed as of the same material.

11. The cinch actuator of claim 10, wherein said material is plastic.

12. The cinch actuator of claim 1 wherein the housing assembly defining a chamber surrounding said threaded rod, at least a portion of said extensible housing member, and at least a portion of said motor.

13. The cinch actuator of claim 12, wherein said linear guide is defined by said housing assembly including a top housing and a bottom housing fixed to one another to bound the chamber, wherein said extensible housing member includes a pair of outwardly extending ribs disposed on opposite sides of a ball which rolls in said chamber along a rail of said bottom housing within said chamber of said housing assembly.

14. The cinch actuator of claim 1 including a bearing and an adaptor connecting said first end of said threaded rod to said motor, wherein said adaptor is disposed between said bearing and said motor.

15. The cinch actuator of claim 14 wherein said housing assembly contains said threaded rod and surrounding at least a portion of said motor, wherein a shaft of said motor is press-fit into said adaptor and a ring formed of rubber is disposed between said motor and said housing assembly.

16. The cinch actuator of claim 1 including a position detector detecting when said extensible housing member is in the fully cinched position and communicating the fully cinched position to a control unit of the vehicle.

17. A door latch assembly for an automotive vehicle, comprising:

a housing assembly;

a door latch;

a cable connected to said door latch for cinching said door latch; and a cinch actuator for pulling said cable to cinch said door latch, said cinch actuator including:

a threaded rod extending along a bad axis between a first end and a second end, an extensible housing member surrounding said load axis and connected to said threaded rod, said extensible housing member connected to said cable, a nut connecting said threaded rod to said extensible housing member, said nut being fixed against relative movement with said extensible member, and a motor connected to said first end of said threaded rod for rotating said threaded rod in a first direction which moves said nut and said extensible housing member conjointly along said load axis toward said motor from a rest position, whereat the latch can be released to allow the door to be opened, to a fully cinched position, whereat the latch cannot be released to prevent the door from being opened from the latched, closed position, and for rotating said threaded rod in a second direction which moves said nut and said extensible housing member conjointly along said load axis away from said motor from the fully cinched position to the rest position, wherein said extensible housing member pulls said cable when moving from the rest position to the fully cinched position; and wherein said housing assembly and said extensible housing member defines a linear guide device for inhibiting rotational movement of said extensible housing member during rotation of said threaded rod as said extensible housing member moves along said load axis between the rest position and the fully cinched position.

18. The door latch assembly of claim 17, wherein said extensible housing member moves to the fully open position after pulling said cable.

19. The door latch assembly of claim 17, wherein said extensible housing member includes a slot disposed adjacent a distal end, said cable includes a ferrule, and said ferrule is disposed in said slot of said extensible housing member.

20. A method of manufacturing a cinch actuator for a latch of a door to cinch the latch via movement by an actuator of the cinch actuator from a rest position, whereat the latch can be released to allow the door to be opened from a latched, closed position, to a fully cinched position, whereat the latch cannot be released to prevent the door from being opened from the latched, closed position, comprising the steps of:

providing a housing assembly;

providing a threaded rod extending along a load axis between a first end and a second end;

disposing an extensible housing member having a nut fixed against relative movement thereto around the load axis;

connecting the threaded rod to the extensible housing member via threaded engagement with the nut; and connecting a motor to the first end of the threaded rod for rotating the threaded rod in a first direction which moves the nut and the extensible housing member along the load axis toward the motor from a rest position to a fully cinched position, and for rotating the threaded rod in a second direction which moves the nut and the extensible housing member along the load axis away from the motor and from the fully cinched position to the rest position; and wherein said housing assembly and said extensible housing member defines a linear guide device for inhibiting rotational movement of said extensible housing member during rotation of said threaded rod as said extensible housing member moves along said load axis between the rest position and the fully cinched position.

21. The method of claim 20, further including coaxially aligning a rotation axis of the motor with the load axis.

* * * * *